United States Patent [19]

Friedl

[11] 4,419,231

[45] Dec. 6, 1983

[54] GROUND SURFACE DRAINAGE APPARATUS

[76] Inventor: Edward L. Friedl, 6797 Little Ct., Coloma, Calif. 95613

[21] Appl. No.: 286,000

[22] Filed: Jul. 23, 1981

[51] Int. Cl.[3] ..... E03F 1/00

[52] U.S. Cl. ..... 210/164

[58] Field of Search ..... 210/164, 166, 170, 165

[56] References Cited

U.S. PATENT DOCUMENTS

| | | | |
|---|---|---|---|
| 638,692 | 12/1899 | Banwell | 210/164 |
| 1,766,621 | 6/1930 | Fleming | 210/165 |
| 2,490,075 | 12/1949 | Matheis | 210/165 |
| 3,516,541 | 6/1970 | Hardingham | 210/164 |
| 3,670,894 | 6/1972 | Friedl | 210/164 |

*Primary Examiner*—Ivars C. Cintins

*Attorney, Agent, or Firm*—Allan M. Shapiro

[57] ABSTRACT

In the ground surface drainage apparatus, a monolithic catch basin has a side outlet sleeve for the positioning therein of a subterranean drainage tube. An adaptor bushing engages against a stop in the sleeve and has its own stop lip for use with a smaller sized drainage tube.

4 Claims, 2 Drawing Figures

GROUND SURFACE DRAINAGE APPARATUS

BACKGROUND OF THE INVENTION

This invention is directed to an improved ground surface apparatus, and more particularly a combination of ground surface drainage parts made of polymer composition material which can be easily assembled for custom installation.

In the past, typical drainage systems have included a network of metal, concrete, or clay drain pipes installed below ground surface level prior to final grading. After the ground has been graded, holes of substantial size are dug down to the drain pipe and the drain pipe opened at locations where drainage is desired. These holes are lined with concrete, brick and mortar, or the like and are covered with a metal grate of appropriate size. Digging and lining such drain holes is both time-consuming and disruptive of the completed grading. The digging of such drain holes is even more disruptive if landscaping has been completed prior to the drain hole digging. Another undesirable result is that it is often difficult to maintain the proper ground level at the drain hole so that such drain basins may be too high or be otherwise improperly positioned. It must also be noted that such drainage systems include large metal grates which mar the appearance of a lawn.

A substantial solution to these problems was accomplished by prior U.S. Pat. No. 3,670,894. While the structure disclosed in that patent solved many of the problems, improvements thereon are advantageous and are are described in this specification.

SUMMARY OF THE INVENTION

In order to aid in the understanding of this invention, it can be stated in essentially summary form that it is directed to an improved ground surface drainage apparatus wherein a catch basin has a top opening of catch basin body diameter and a larger sleeve formed thereon for receipt of an extension tube. The grate for positioning therein has two outer surfaces, one which engages within the catch basin body and another which engages within the sleeve. In addition, the catch basin has a slide drain tube sleeve formed therewith which has a stop shoulder therein so that a drainage tube can engage against the stop shoulder. An optional drain tube bushing can engage against the stop shoulder and the drainage sleeve has its own interior stop shoulder therein for engagement by a drain tube of smaller diameter.

It is, thus, an object of this invention to provide an improved ground surface drainage apparatus wherein stop shoulders are provided for the grate so that an upper extension tube for the grate is properly controlled.

It is another object to provide a catch basin structure in a ground surface drainage apparatus wherein a stop shoulder is provided to control the entry of a drainage tube into the catch basin.

It is a further object to provide a bushing suitable for introduction into the drainage tube sleeve on the catch basin for use with a smaller size of drainage tube and to provide in the bushing a stop shoulder to control the entry depth of the drainage tube.

It is another object to provide an improved ground surface drainage apparatus including easy-to-assemble polymer composition material members, including a one-piece catch basin with a grate thereon which can be placed at a desired height with respect thereto.

It is another object to provide a ground surface drainage apparatus wherein one or more drain tubes may be installed on the side of the catch basin without the drain tubes entering too far into the catch basin.

The features of the present invention which are believed to be novel are set forth with particularity in the appended claims. The present invention, both as to its organization and manner of operation, together with further objects and advantages thereof, may be best understood by reference to the following description, taken in connection with the accompanying drawings.

DESCRIPTION OF THE PREFERRED EMBODIMENT

Figure 2:
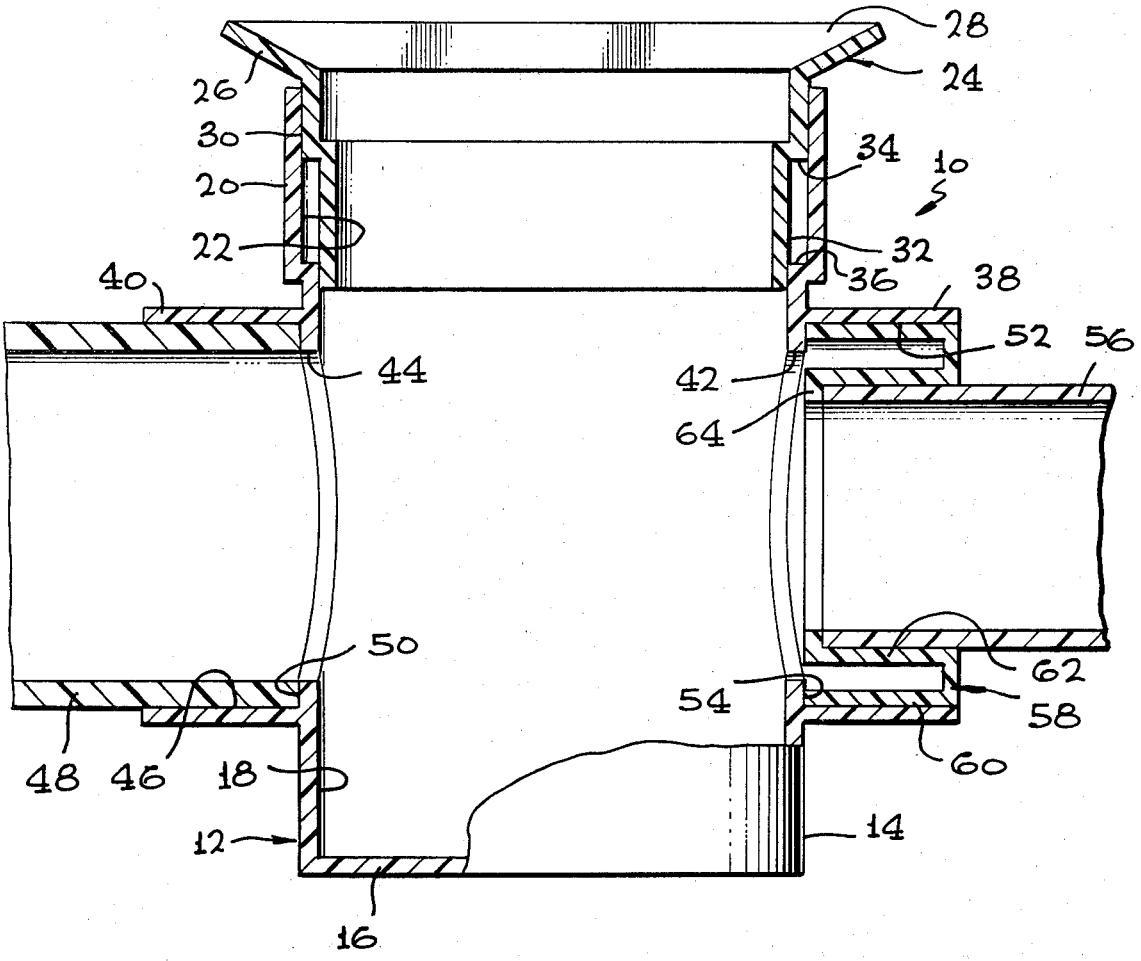
FIG. 2 is an enlarged vertical section through the center line of the catch basin thereof, showing installation of the grate, the drain tubes and the optional bushing.
Figure 1:
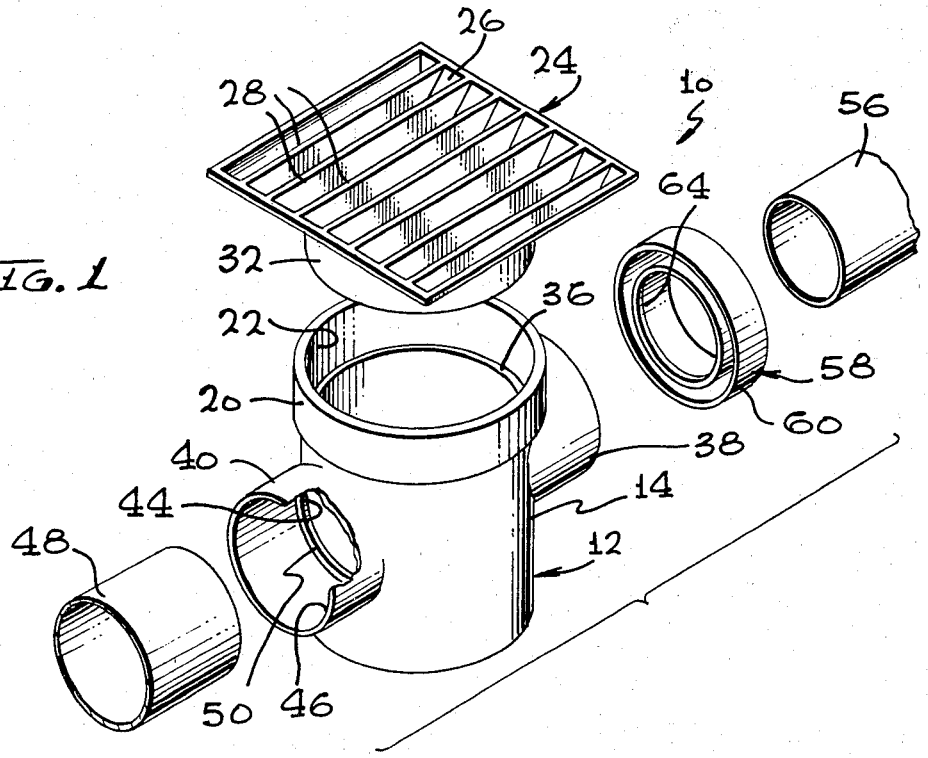
FIG. 1 is an exploded isometric view of the improved ground surface drainage apparatus in accordance with this invention.

The improved ground surface drainage apparatus of this invention is generally indicated at 10 in FIGS. 1 and 2. The principal, central structural part of the apparatus 10 is the catch basin 12. Catch basin 12 has a generally cylindrical tubular body 14 and a closed bottom 16. Body 14 has an interior cylindrical surface 18 which extends upward and defines the interior diameter of the body. Upper sleeve 20 is formed as an upper part of the body, has an interior diameter 22 which is larger than the surface 18, and is preferably substantially coaxial.

Grate 24 may be circular or rectangular in plan view. As seen in FIG. 1, in the preferred embodiment, grate 24 is square. It has outwardly and upwardly extending upper flanges 26, four number and rectangularly positioned, to form a funnel-like upper structure. Grate bars 28 extend across the flanges and are spaced to permit the downward flow therethrough of water, but prevent the passage of larger debris. Grate 24 has a cylindrical neck 30 having an outside surface such as to slide within the inner surface 22 of the upper sleeve 20. Below neck 30 is tube 32 which has an outside diameter to slide within the interior cylindrical surface 18 of body 14 of the catch basin.

Shoulder 34 is located between the neck 30 and tube 32. A similar shoulder 36 is positioned between sleeve 20 and body 14. These shoulders are positioned on these parts so that, when the grate 24 needs to be higher than permitted by the engagement of neck 30 within sleeve 20, then an extension tube can on its upper end be embraced around tube 32 and engaged against shoulder 34 on its top end, and on its bottom end can be engaged within sleeve 20 and against shoulder 36. By cutting this extension tube off at the desired length, grate 24 can be positioned at the desired height with respect to catch basin 12. The advantage of this structure is that the shoulders on both parts provide positive positioning.

Inlet and outlet sleeves 38 and 40 are integrally formed on the sides of body 14, and in the preferred embodiment, both such sleeves are provided and are positioned opposite to each other. The sleeves are open to the interior of body 14 through openings 42 and 44 in the sidewall of the body. In some cases, it may be desireable that only an outlet sleeve be provided for outlet connection and, in such a case, the body 14 may be provided with only the outlet sleeve 40 or the inlet sleeve 38 may be plugged. In other cases, two sleeves at 90 degrees from each other may be helpful, or three such sleeves at 90 degrees from each may be utilized. In any event, catch basin 12 is formed with as many sleeves as are desired and, in the present preferred embodiment, two are illustrated.

As is seen with respect to outlet sleeve 40, it is a cylindrical tube having an interior wall 46 which is of such diameter to accept tubular outlet drain pipe 48. Shoulder 50 is provided as a stop shoulder for drain pipe 48 so that the drain pipe does not enter into the interior of catch basin 12 to interfere with interior flow.

Inlet sleeve 38 is of the same structure with an interior wall 52 with its stop shoulder 54. With this structure, an inlet drain pipe the same size as outlet drain pipe 48 may be installed, abutting against stop shoulder 54. In some cases, an inlet drain pipe 56 of smaller diameter may be preferred. In such a case, bushing 58 is provided. Bushing 58 has an outer tube 60 which fits within sleeve 38 and abuts against stop shoulder 54. Interiorly thereof is inner tube 62 within which fits inlet drain pipe 56. Stop shoulder 64 is provided at the inner end of tube 62 to provide a stop limit for inlet drain pipe 56. The entire bushing 58 is preferably made in one piece.

Each of the pipes of the ground surface drainage apparatus 10 is preferably individually molded as one monolithic piece of synthetic polymer composition material. The material is chosen to be sufficiently rigid to hold its form under the ground pressures and is resistant to the buried-in-the ground environment for long use. The inlet drain pipe 56, its bushing 58, and the outlet drain pipe 48 may be adhesively bonded in place. However, the grate 24 is preferably not bonded so that it may be removed for cleaning out the sump of catch basin 12. More important however, is the feature that the catch basin may be removed and set in at a different height whenever the ground surface contour changes. Different height is accomplished by placing a different length of extension tube between the shoulders 34 and 36. It should be noted that tough, lightweight, non-corrosive polymer composition materials are available. Polystyrene is injection-moldable and is a suitable material. Furthermore, the molded material may be colored with a grass-like color to minimize its visibility in place.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A ground surface drainage apparatus comprising:

a catch basin, said catch basin having a substantially tubular cylindrical body arranged to be uprightly positioned below the ground surface to receive drainage water therein, said body having a closed bottom, an interior body diameter, and an open top edge, said top edge consisting of and being defined by a single horizontal upwardly directed annular body stop shoulder;

an upper sleeve integrally formed with said body at the top thereof, said upper sleeve being a cylindrical tube having an interior surface with an inner diameter larger than said interior body diameter to surround said body shoulder, said sleeve having a top edge consisting of a single horizontal upwardly directed annular sleeve shoulder;

a grate for positioning at the top of said sleeve and body so that ground surface water can pass through said grate downwardly into said catch basin, said grate having grate bars thereon to restrict flow of debris into said catch basin, said grate having a downwardly directed cylindrical neck of an outer diameter to slidingly fit within said interior surface of said upper sleeve on said catch basin body, said grate also having a downwardly directed tube integrally formed with said neck, said downwardly directed tube being smaller than said neck to form a single horizontal downwardly directed annular stop shoulder therebetween at the bottom end of said neck, said tube having an outer diameter the same as said interior body diameter so as to slidingly fit within said catch basin body, said stop shoulder on said bottom end of said neck and said stop shoulder on said catch basin body facing each other and spaced from each other to avoid contact, said sliding fit of said neck and tube with said sleeve and body, respectively, providing lateral positional security of said grate with respect to said body, said grate having outwardly extending flanges for resting upon said upper sleeve shoulder for vertical security, said stop shoulders being only for selectable insertion therebetween of an extension tube.

2. The ground surface drainage apparatus of claim 1 wherein an outlet sleeve is integrally formed with and extends laterally from the side of said catch basin body, said outlet sleeve being positioned between said upwardly facing stop shoulder and said bottom of said catch basin body, said outlet sleeve being dimensioned to receive an outlet drain pipe therein, said outlet sleeve having a stop shoulder therein to limit the insertion of the outlet drain pipe into said sleeve to prevent the outlet drain pipe from entering into said body of said catch basin, said stop shoulder comprising an integral portion of said catch basin body at the inner end of said sleeve.

3. The ground surface drainage apparatus of claim 2 wherein there are two of said sleeves integrally formed on the sides of said catch basin, one of said sleeves being an inlet sleeve and the other of said sleeves being said outlet sleeve, said inlet sleeve having therein a stop shoulder comprising an integral portion of said catch basin body at the inner end of said inlet sleeve to stop an inlet drain pipe from entering into said body of said catch basin.

4. The ground surface drainage apparatus of claim 3 wherein a bushing is positioned within one of said catch basin side sleeves, said bushing having an outer tube the same length as and fitting within said side sleeve and engaging against said stop shoulder within said side sleeve, said bushing also having an inner tube the same length as said side sleeve into which a drain pipe of smaller diameter than said side sleeve may be inserted, said inner tube having a stop shoulder thereon at its inner end to limit insertion of a drain pipe of such smaller diameter to prevent its entry into said body of said catch basin.

* * * * *